US005490045A

United States Patent [19]

Lindner

[11] Patent Number: 5,490,045

[45] Date of Patent: Feb. 6, 1996

[54] BARRIER LIGHT WITH LENS-COUPLED, SELF-ORIENTING LIMITED FIELD LIGHT SOURCE

[75] Inventor: Henry Lindner, Elgin, Ill.

[73] Assignee: Elgin Molded Plastics, Inc., Elgin, Ill.

[21] Appl. No.: 419,998

[22] Filed: Apr. 10, 1995

Related U.S. Application Data

[63] Continuation-in-part of Ser. No. 315,322, Sep. 29, 1994.

[51] Int. Cl.[6] ..... F21V 21/30

[52] U.S. Cl. ..... 362/35; 362/186; 362/269; 362/332; 362/335; 340/908.1

[58] Field of Search ..... 340/908, 908.1; 362/35, 191, 197, 269, 273, 285, 287, 289, 418, 419, 186, 427, 326, 332, 335

[56] References Cited

U.S. PATENT DOCUMENTS

| | | | |
|---|---|---|---|
| 2,603,689 | 7/1952 | Rieder | 340/908 |
| 3,024,093 | 8/1965 | Heenan | 340/908.1 |
| 3,221,300 | 11/1965 | Elledge, Jr. | 340/908.1 |
| 4,482,941 | 11/1984 | Lindner | 362/186 |
| 4,717,991 | 1/1988 | Murphree, Jr. | 362/35 |

*Primary Examiner*—Ira S. Lazarus
*Assistant Examiner*—Alan B. Cariaso
*Attorney, Agent, or Firm*—Olson & Hierl, Ltd.

[57] ABSTRACT

An improved barrier light assembly is provided of the type wherein the lens subassembly is pivotable relative to the case subassembly. The assembly employs a limited field light source (preferably an LED with a field of about 34°), and incorporates a self-orienting, lens coupled holding and positioning subassembly for such a light source whereby this light source remains fixed at the lens subassembly focal point with its emission center line extending along the lens center line regardless of the pivoted position of the lens subassembly.

23 Claims, 4 Drawing Sheets

BARRIER LIGHT WITH LENS-COUPLED, SELF-ORIENTING LIMITED FIELD LIGHT SOURCE

RELATED APPLICATION

This application is a continuation-in-part of my earlier filed U.S. patent application Ser. No. 08/315,322 filed Sep. 29, 1994.

FIELD OF THE INVENTION

This invention relates to improved self-powered barrier lights that incorporate a pivotable lens, a limited field light source, and a lens-coupled, self-adjusting light source orienting means.

BACKGROUND OF THE INVENTION

Battery powered, self-contained, water resistant barrier light structures for marking the presence of a construction site or other potentially hazardous location along a roadway have become a standardized means for warning oncoming motorists of nighttime roadway dangers. Typically, a barrier light structure is supported on a so-called barrier, horse or like support, and has a lens that is pivotable relative to a base so that, when a barrier light structure is being positioned at a construction site by a road worker, its lens can be oriented (i.e., pivoted) relative to its base for optimized viewability by the drivers of oncoming vehicles.

In a barrier light structure, the relationship between the light source (or bulb) and the lens is preferably such that the lens functions to focus the light leaving the lens into a predetermined pattern.

The conventional light source heretofore employed in a barrier light structure has been a small incandescent light bulb of the conventional type having a filament that when actuated (i.e., excited by electrical energy from the battery means in the base) emits light generally uniformly in all directions. Such a light bulb has been particularly convenient for use in a barrier light structure because the bulb was stationarily positionable at the focal point of the lens. Hence, the lens could be pivoted about a vertical axis that passed through the focal point, and the light-emitted by the energized bulb after passing through the lens, would be focused into a predetermined pattern, as desired.

The construction industry seeks to minimize the cost of labor associated with barrier lights. To avoid the manual labor requirement to turn each individual barrier light employed at a construction site on in the evening and off the following morning, it has become conventional to incorporate a photocell-actuated switch means into a barrier light structure. Thus, a barrier light structure so equipped automatically turns itself either on or off in response to the ambient light level. Although the typical so-equipped barrier light is also provided with manually operable on/off switch means, this latter switch means is seldom if ever used, even when a barrier light is being stored between usages, to avoid labor costs. The life of a set of non-rechargeable batteries in a barrier light is somewhat variable, being dependent on such variables as, for example, (a) whether the light is set to operate continuously or intermittently (i.e., blinks), and (b) the ambient environmental conditions (length of night, temperature, etc.). However, in field practice, batteries in a conventional barrier light are seldom replaced, owing to labor costs. The duty life of a conventional barrier light is thus practically set by non-rechargeable battery life. For a conventional prior art barrier light with a 6 or 12 volt incandescent light bulb and with two series-connected, standard size, lantern, non-rechargeable batteries, the battery operating life in a conventional barrier light structure is currently believed to be about 500 hours under average field conditions which translates into roughly about four to six weeks of use (or duty) life for a conventional barrier light structure.

The art needs an improved barrier light structure which is characterized by a substantially improved useful operating life preferably achieved from the same batteries as previously employed in prior art barrier light structures. The present invention satisfies this need by solving the below-characterized deviation angle problem:

Recently, new and very efficient light sources having limited light-emitting fields, such as light emitting diodes (LEDs), have become commercially available which typically have relatively broad spectral wavelength bandwidths and which exhibit efficient a high efficiency of conversion of electrical energy into photon energy (that is, a greater conversion efficiency than the conversion efficiency achieved by correspondingly sized conventional incandescent bulbs). Particularly because of their energy converting and using efficiency, such limited field light sources would appear to be attractive substitutes for conventional incandescent light bulbs in a barrier light structure. For example, a LED with a limited light emitting angle of about 34° apparently can be continuously operated with a pair of series-connected, standard-size lantern, non-rechargeable batteries for a time of about 1,100 continuous hours. Theoretically, the duty life of a barrier light structure equipped therewith would be extended for a time that is at least about twice that of a corresponding prior art barrier light structure incorporating a uniformly light emitting prior art incandescent light bulb. A barrier light structure so equipped would have a useful operating life of roughly at least about three months using a single set of series-connected, standard-size, barrier, non-rechargeable batteries.

Compared to conventional incandescent light bulbs, however, such an LED suffers from a severe disadvantage: The light-emitted therefrom is distributed generally uniformly only in a limited field that extends only over a limited generally uniform angle that extends outwardly and laterally about a light emission center line that extends forwardly from the light emission point. For example, an LED 121 having limited light emitting angle 122 of about 34° (or an angle 123 of about 17° around and outwardly extending relative to the LED emission center line 124) is illustratively shown in FIG. 1.

Were such an LED 121 to be located in a fixed position at the focal point 125 of a barrier light structure lens 126, as shown, for example, in FIG. 2, so that the LED emission center line 124 is coincident with the lens axis or center line 127 that extends between the lens focal point 125 and the lens center point 128, substitution of such LED 121 for a conventional fixed position incandescent light bulb (not shown) would be possible, as those skilled in the art will readily appreciate. As used herein, the term "focal point" in reference to a barrier light structure lens 126 has conventional reference to the point from which light rays that diverge from a substantially point source along the lens 126 axis or center line 127 and that strike the inside face of the lens 126 are focused (or bent) by passage through the lens 126 to produce transmitted light rays that are substantially parallel to the lens center line 127.

In the art of barrier lights, it is preferred to employ as a lens 126 one which has a relatively short focal length. The term "focal length" as used herein in reference to a barrier light structure lens 126 has conventional reference to the distance from the focal point of a lens 126 preferably taken along the lens center line 127 to the lens 126 center point 128. In order to minimize the focal length in a barrier light lens, it is preferred in the art to employ a Fresnel lens which is a relatively thin lens constructed with stepped setbacks so as to have the optical properties of a much thicker lens.

However, when, as shown, for example, in FIG. 3, the lens center line 127 spatial position is changed while the spatial position of the LED 121 and also of the LED emission center line 124 remain fixed (as in a prior art barrier light assembly with a pivotable lens that is hypothetically fitted with an LED in place of the incandescent bulb), a severe problem arises. As the lens 126 is pivoted about a vertical axis 129 (indicated as a point in FIG. 3) that passes through the lens focal point 125 (and through the light emitting source in LED 121), emitted light from the LED 121 becomes increasingly lost and is not passed through the lens 126. The amount of light energy so lost is directly related to the size of the pivot deviation angle 131 that is defined between the lens center line 127 and the LED emission center line 124 relative to the lens focal point 125 taken as the apex of the deviation angle 131.

As the deviation angle 131 increases from the 0° position shown in FIG. 2, the limited field light from the LED 121 that reaches and passes through the lens 126 decreases and becomes distorted. When the deviation angle 131 exceeds a maximum value, substantially no emitted light from the LED 121 is transmitted through the lens 126.

As a consequence of such light distortion and light energy loss, it is not possible merely to substitute a fixed position LED for a fixed position incandescent bulb in a prior art barrier light structure wherein the lens is so pivotable.

No way is believed to be known to the prior art by which this deviation angle problem could be overcome so that the LED could be used as the light source in a barrier light structure with a pivotable lens arrangement.

The present invention solves this deviation angle problem and enables one to use, in a barrier light structure having a pivotable lens, a limited field light source (such as, for example, an LED or the like, whose light-emitting field extends illustratively over a total included angle of not more than about 34°). The duty life of the resulting barrier light structure is thereby greatly extended over the corresponding prior art barrier light structures, as desired.

SUMMARY OF THE INVENTION

This invention relates to an improved self-powered, self-contained barrier light structure that incorporates a coacting combination of a base which is preferably adapted for battery-holding, a lens pivotably associated with the base, a light source having a limited light-emitting field, and a lens-coupled, self-adjusting, light source supporting and orienting subassembly.

In this combination, the light source supporting and orienting means not only maintains the limited emitting field light source substantially at the lens focal point, but also maintains the emission center line of the limited field light source substantially coincident with the lens center line regardless of the angular pivot position of the pivotable lens relative to the base. Thus, the above-indicated deviation angle problem is completely overcome.

Hence, the present invention enables one to incorporate a limited field light source into a barrier light assembly with a lens that is pivotable relative to the base, thereby to achieve the potential for increased useful life of a barrier light structure with a single non-rechargeable battery means.

Advantageously, the inventive combination is achievable in a barrier light structure of the class that is already commercially accepted with relatively few structural alterations in the structure of such accepted class. This circumstance improves utilization and marketability of the present invention. Also, this circumstance reduces the cost of manufacturing embodiments of the improved barrier light structure of this invention. Further, this circumstance reduces the cost per performance hour in the class of barrier light structures that already enjoy existing market acceptance.

The present invention provides, in one aspect, a new and very useful lens coupled, holding and positioning subassembly for use in a barrier light structure having a lens subassembly that is pivotable relative to a base or case. This holding and positioning subassembly is simple, reliable and substantially maintenance-free. This subassembly effectively couples such lens subassembly with a limited field light emitting source to overcome the deviation angle problem.

The invention provides, in a preferred embodiment, a barrier light assembly formed mainly of structural components comprised of plastic and incorporating a case subassembly, a lens subassembly, a housing subassembly for electrical components (and including a projecting hollow pedestal or stem), and a subassembly whereby a light source of limited light-emitting field is supported and oriented spatially in a desired configuration relative to a lens subassembly regardless of the pivot position of that lens subassembly. Preferably, such structural components cooperate to provide a water-resistant barrier light structure.

Other and further objects, aims, purposes, features, advantages, embodiments and the like will be apparent to those skilled in the art from the teachings of the present specification taken with the accompanying drawings and the appended claims.

DETAILED DESCRIPTION

Figure 4:
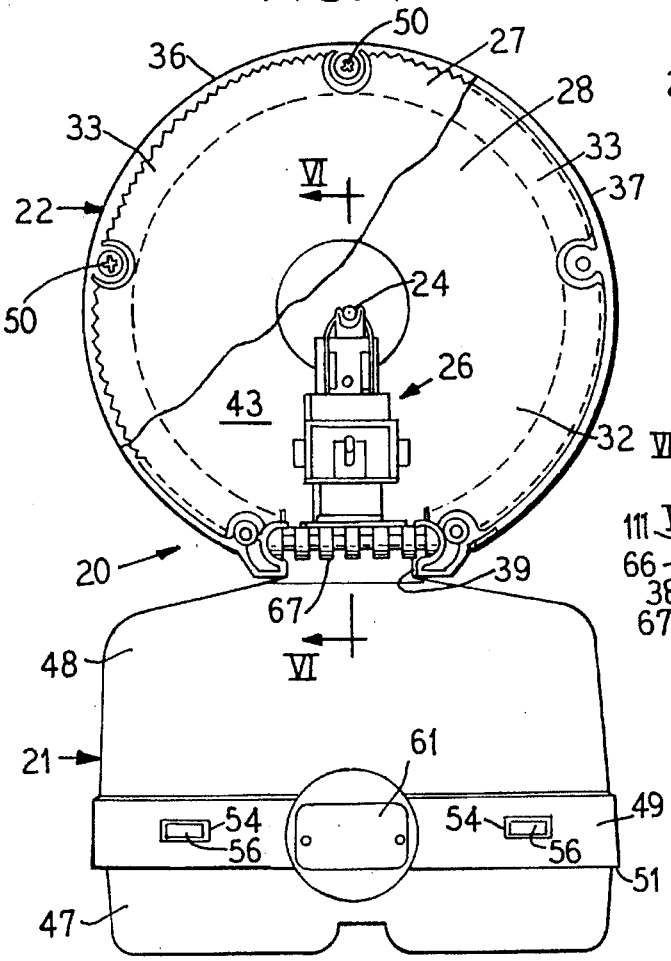
FIG. 4 is a side elevational view of one embodiment of a barrier light structure of this invention with a portion of one lens being broken away.
Figure 6:
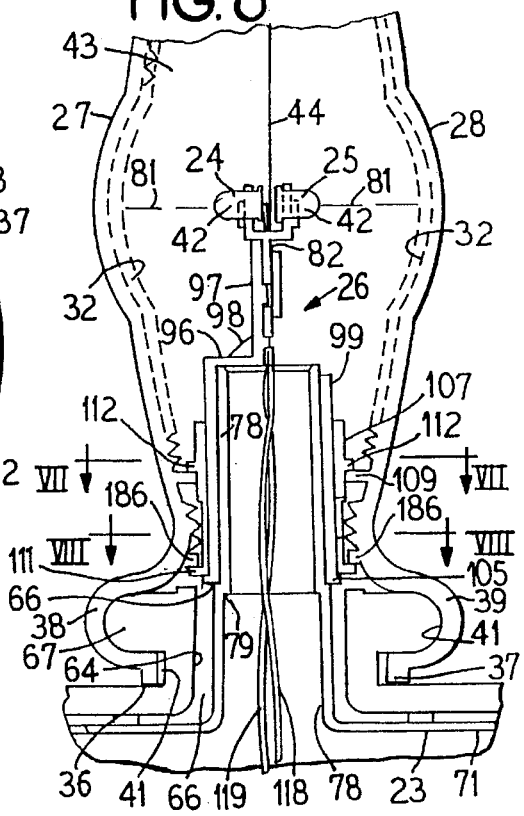
FIG. 6 is a fragmentary axial sectional view taken along the line VI—VI of FIG. 4.

Referring to FIGS. 4–13, there is seen one embodiment of an improved weatherable barrier light assembly of the present invention herein designated in its entirety by the numeral 20. The structure of barrier light assembly 20 is seen to comprise in combination a case subassembly 21, a lens subassembly 22, an interior housing 23 for electrical components (see, for example, FIG. 9), two limited field light sources 24 and 25 (see, for example, FIG. 6), and a self-orienting, lens coupled, holding and positioning subassembly 26 for the light sources 24 and 25.

The case subassembly 21 functions as a base and can have various structures, as those skilled in the art will appreciate. Here, the case subassembly 21 is comprised of a lower portion 47 and an upper portion 48. Any convenient means can be employed for securing these portions 47 and 48 together. Here, the portion 48 is provided with a perimeter region 49 about the mouth 51 thereof that is nestably receivable over mating portions of a perimeter region (not shown) formed about the mouth (not shown) of the lower portion 47. The case subassembly 21 has a structure similar to that shown in my earlier U.S. Pat. No. 4,482,941. In perimeter region 49, a plurality of slots 54 are formed preferably on one side thereof which are adapted for mating receipt therein of corresponding projections 56 matably positioned in the perimeter region of lower portion 47. Thus, when the upper portion 48 is mounted and engaged with the lower portion 47, a snap-type fit is achieved between upper and lower portions 48 and 47, respectively. To secure together and positively lock the upper portion 48 to the lower portion 47, a conventional bolt 61 is extended transversely through the perimeter region 49 and through a channel (not shown but in lower portion 47) so that bolt 61 is threadably received in a securing nut member (not detailed) located at the opposite side of perimeter region 49. A pair of pockets (not detailed) is defined integrally in lower portion 47 which serve for receipt therein a pair of batteries (not detailed) in the assembled and operative light assembly 20. A cavity existing in the upper portion 48 is sized to accommodate the upper portions of the batteries used.

The upper portion 48 is provided with an upwardly extending neck 64 (see, for example, FIG. 6) that terminates in an upwardly opening mouth 66. Neck 64 is provided with a radially (relative to neck 64) outwardly thickened, circumferentially extending lip 67. The lip is provided with a plurality of ribs (see FIG. 4) to avoid heat shrinkage problems after upper portion 48 is molded and allowed to cool.

In the barrier light assembly 20, the lens subassembly 22 is generally conveniently circular in side elevation and is comprised of a pair of matingly engagable identical lens halves 27 and 28. As in the lens subassembly provided in my U.S. Pat. No. 4,482,941, the circumferentially located, longitudinally extending, inwardly flanged periphery 36 and 37 of each half 27 and 28 is preferably provided with an outstanding terminal axially projecting bead (not shown) which extends in a hemicircular path. The remaining hemicircular peripheral path of each mating half of each lens half 27 and 28 is preferably provided with a circumferentially extending groove (not shown). Thus, when the two halves 27 and 28 are placed in opposed, assembled, mating relationship relative to each other, the bead on lens half 27 seats in the groove on lens half 28, and vice versa, thereby to provide an interlocking relationship between the respective halves 27 and 28 in their assembled configuration. An added advantage of such a combination of beads 29 and grooves 31 is that it provides a precise interlocking, self-aligning relationship between the respective identical lens halves 27 and 28.

While each lens half is preferably formed by injection molding or the like of a molded plastic having a clear, transparent character, a presently most preferred material for these lens halves 27 and 28 comprises a polycarbonate.

At the interior concave central surface portion 32 of each lens half 27 and 28, there is formed a lenticular faceting, preferably of the Fresnel-type. It is presently preferred to have the central region of each lens half 27 and 28 have a dioptric configuration and to have the radially adjacent outer region of each lens half have a catadioptric configuration. A circumferentially extending band 33 extending radially outwardly about the edge of each lenticular region 32 is further preferably provided on its interior surfaces with formed retroreflective facets that preferably are of the typical hexagonally shaped cube corner type.

An advantage of using a Fresnel-type lens is that the central surface portions 32 of each half 27 and 28 can thereby be axially flattened or reduced in curvature, thereby to produce a desired short focal length light focusing characteristic with minimal axial lens projection. The lens halves 27 and 28 each have a similar focal point 42 that is located about at the center of a chamber 43 that is formed within the lens assembly 22.

Each lens half 27 and 28 is provided with an integrally formed collar half 38 and 39, respectively, that is located along, and is formed generally within, the respective flanged periphery 36 and 37 thereof. Each collar half 38 and 39 is cooperative with the other in the assembled lens subassembly 22 so that the resulting so formed collar 38/39 defines a circular orifice 41 that is located along and about a center diameter or vertical axis 44 of the lens subassembly 22. Diameter 44 extends outwardly from the approximately common focal point 42 of the respective lenticular central portions 32 in the lens assembly 22. The collar halves 38 and 39 in the assembled lens subassembly 22 are also configured so as to continuously circumscribe and engage slidably the lip 67 of the case subassembly 21. Thus, the assembled lens subassembly 22 is pivotable relative to the case subassembly 21 between the collar 39/39 and the lip 67, such pivoting being about an axis extending along and defined by the diameter 44. Those skilled in the art will appreciate that various other arrangements can be employed to make the lens subassembly pivotable relative to the case subassembly.

To fasten together the lens halves 27 and 28, a plurality of circumferentially spaced, integrally formed, internally located aligned sleeves (not detailed) are preferably provided such as disclosed in my prior U.S. Pat. No. 4,482,941. When a round head, self-tapping screw 50 is extended from the exterior spirally and axially through the center region of each aligned pair of sleeves 46, it generates its own threads in the plastic material of the sleeves 46. A plurality of screws 50 thus are used to fasten the lens halves 27 and 28 together in their assembled configuration. However, any convenient lens half fastening means can be employed.

In the barrier light assembly 20, the interior housing subassembly 23 contains and supports electrical components including preferably a switch assembly (not detailed, but conventional) that preferably incorporates a photo-cell activation component (not shown, but conventional) so that the light sources 24 and 25 are automatically turned on at sunset and off at sunrise. The switch assembly is known to the prior art and does not as such constitute a part of the present invention. The housing 23 is conveniently comprised of two components such as shown for example, in my previous U.S. Pat. No. 4,482,941. Batteries (not shown) in the case subassembly 21 are electrically engagable with the switch assembly. Preferably, the switch assembly can be turned on or off, if desired, with a manually manipulated end of a wire plunger or the like (not shown) which is extendable through an access hole into abutting and operative association with a switch.

Upstanding from, and integral with, a center portion of a mounting plate 71 located horizontally in an upper portion of housing 23 is a cross-sectionally circular, elongated pedestal 78 which extends vertically upwardly through the neck 64 up into the interior of the chamber 43 in the lens subassembly 22. The axis of the pedestal 78 lies along and is substantially coaxial with the diameter 44, and the upper end of the pedestal 78 is in downwardly spaced relationship to each focal point 42. A stepped reduction in the diameter of pedestal 78 is preferably provided by a circumferentially extending shoulder 79 defined in a mid-region of pedestal 78. The shoulder 79 is located so as be about at the edge portion of the lenticular center portion 32 and also just above the mouth 66.

A pair of limited field light sources 24 and 25 is utilized in barrier light assembly 20, one light source being provided for each lens half 27 and 28. Although, as those skilled in the art will readily appreciate, such an individual light source 24 and 25 can have various structures, it is presently convenient and preferred to use individual light sources which, when electrically energized by the battery means housed in the case subassembly 21, emit a conically configured substantially uniform field of light so that this light is substantially uniformly distributed about an emission center line. The light emitting structure in such a light source is conventionally housed in a transparent (or clear) glass or plastic bulb structure through which the light is emitted. Typically, a rear portion of the bulb structure is provided with electrical contacts that are associatable by soldering or the like with electrically conducting wires. The presently most preferred limited field light emitting structures for use in the present invention are LEDs of the hereinabove characterized type that have when energized a light emission field of about 34° (or about 17° around and outwardly extending from the LED emission center line).

Each light source 24 and 25 is positioned approximately at the focal point 43 of a different respective one of each of the two central lenses 32 in the lens subassembly 22 so that the emission center line of each light source 24 and 25 lies along, and is preferably coincident with, the lens center line 81. Since the lens halves 27 and 28 are oriented in the lens subassembly 22 in opposed relationship, the lens center line 81 of each lens 32 is coaxial with the other and forms a substantially straight line that passes through (or intersects) diameter 44.

To support each light source 24 and 25 in such a desired respective position, a light source holder 82 is provided. In the edge elevational view thereof shown in FIGS. 6 and 19, for example, holder 82 is seen to have a Y-type of configuration. Each of the legs 83 and 84 of holder 82 individually has an L-type of configuration and is joined at its lower end to the upper end of a straight stem 86. The legs 83 and 84 are arranged in symmetrical, opposed mirror-image type relationship to each other. The legs 83 and 84 and the stem 86 are flattened in side width. Holder 82 is formed conveniently and unitarily of a single piece of non-conducting molded plastic or the like. The upper flattened terminal region of each leg 83 and 84 is provided with a notch 87 and each notch 87 along its base region is provided with an outturned flange 89. Each notch 87 and its respective associated flange 89 is configured to receive and support a different one of the bulb portions of each of the light sources 24 and 25, thus placing such light sources 24 and 25 in a back-to-back relationship with their respective emission center lines being approximately coaxial.

Each light source 24 and 25 has two energizing wires associated therewith. The respective individual adjacent corresponding such wires of each light source 24 and 25 are fastened together to provide a wire pair, preferably by soldering commencing at a location adjacent to each light source 24 and 25, thereby to provide two interconnected respective such wire pairs. Such an arrangement helps rigidfy the back-to-back relationship between the light sources 24 and 25 and also helps to maintain seating of the individual respective bulb portions each light source 24 and 25 in the respective associated notches 87. Each of the wire pairs of the light sources 24 and 25 is further soldered to an end of a different lead wire 118 and 119 (preferably insulated). Each lead wire 118 and 119 extends downwardly from a different side of the legs 83 and 84 of holder 82 (see FIG. 6, for example). Adjacent its lower end, the stem 86 is provided with a hole 94 whose function is described below.

The barrier light assembly 20 incorporates a self-orienting lens coupled holding and positioning subassembly 26 for the light sources 24 and 25. The subassembly 26 includes a bushing 99 which mounts slidably over the upper end region of the pedestal 78 and which has its bottom end preferably rest against the shoulder 79. As so positioned, the bushing 99 is slidable and rotatable relative to pedestal 78. The top end of bushing 99 is provided with hemicircular, integrally formed cap plate 96. Integrally formed diametrically across the cap plate 96 is an upright, flattened, diametrically extending, generally rectangular bracket 97. Optionally but preferably, the cap plate 96 and the bracket 97 are provided with at least one reinforcing bracing rib 98. On the side of bracket 97 adjacent to the axis (not shown) of bushing 99, a pair of spaced, parallel raised channels 101 are integrally formed that are equally spaced from this axis. An open slot 102A is provided in bracket 97 behind each channel 101. The interior ends of these slots are joined together by a cross slot 102B at their inner ends (adjacent plate 96), thereby to define a continuously extending U-shaped slot 102 that outlines (in effect) a tongue-like extension 103 in the bracket 97 that depends from the upper end of bracket 97.

Radially projecting on the axially adjacent side of 23 (relative to bushing 99) of the tongue-like extension 103 is an integrally formed raised detent 104 that has an inclined outer end face. The diametrical spacing between, and the configuration of, the channels 101 is adapted to axially receive and accommodate slidably the opposite sides of the stem 86 of holder 82. When stem 86 is so received, the hole 94 in stem 86 passes over the detent 104 end face and moves (flexes) the tongue-like extension 103 radially until the hole 94 receives the detent 104 as the stem 86 is slidably and axially moved within the channels 101, thereby locking the holder 82 to bracket 97 in a desired prechosen position. The holder 82 and the light sources 24 and 25 are thus aligned with the diameter 44 and the light sources 24 and 25 are positioned and maintained in the spatial orientation desired relative to the lens halves 27 and 28 and the lens focal points 42.

Release of the stem 86 from the bracket 97 is achieved by depressing the end face of detent 104 with a pointed object, thereby causing tongue-like extension 103 to flex, so that the detent 104 is separatable from the stem 86, and permitting the stem 86 to be removed slidably and axially from channels 101.

To cause these light sources 24 and 25 to remain oriented so that their respective emission center lines coincide with lens center line 81 when the lens subassembly 22 is pivoted relative to the case subassembly 21, the bushing 99 is provided with an elongated, longitudinally extending, integrally formed, externally radially raised key 106 and preferably also with a circumferentially extending terminal lower end shoulder flange 105.

A sleeve 107 is provided which slidably and axially extends over the outside of bushing 99. Bushing 99 and its bracket 97, and sleeve 107 are conveniently each formed of a molded thermoplastic. The bottom of sleeve 107 rests on shoulder flange 105. Sleeve 107 is provided in its circumferential sidewall with a longitudinally extending, radially projecting, covered keyway 108. The keyway 108 is slidably receivable over the key 106. As a consequence, when the bushing 99 rotates with the sleeve 107 in place thereover, the sleeve 107 also rotates similarly (and vice versa).

To couple the sleeve 107 to the lens half 27, the following arrangement is provided. Above but adjacent to the collar half 38 and in the outer edge region of central lenticular portion 32, a first U-configured, axially outstanding, circumferentially elongated but straight-sided sleeve support 186 is integrally provided. Radially (relative to center portion 32) inwardly (and upwardly) spaced from the first sleeve support 108, a second U-configured circumferentially elongated but straight-sided sleeve support 109 is integrally provided in lens half 27. Sleeve 107 is provided with an axially spaced pair of circumferentially and outwardly extending shoulders 111 and 112. Shoulder 111 extends circumferentially about the lower end of sleeve 107 that is adjacent to flange 105. When the outside of sleeve 107 is seated upon sleeve supports 186 and 109, each shoulder 111 and 112 is adjacent to, and in contact with, a different respective outside (relative to the two sleeve supports 186 and 109) edge of each sleeve support 186 and 109, thereby preventing axial movement of sleeve 107.

To prevent sleeve 107 from rotating relative to lens half 27, a first flat area 113 is provided in an outside circumferential surface portion of sleeve 107 preferably adjacent to rib 111. When the sleeve 107 is positioned upon the sleeve supports 108 and 109, the interrelated sizes of the components are such that first flat area 113 rests squarely against radially adjacent portions (typically raised elements of a Fresnel lens feature, not detailed) of the central portion 32. Thus, sleeve 107 is only rotatable with pivotal movements of lens half 27 in the assembled barrier light assembly 20.

The relationship between the lens half 28 and the sleeve 107 is similar to that between lens half 27 and sleeve 107. Lens half 28 is likewise provided with sleeve supports 186 and 109. A second flat area 114 (see FIG. 13) is provided on the opposite side of sleeve 107 which likewise fits squarely against radially adjacent portions (not detailed) of the lens half 28 opposed locating tabs 145 are preferably provided on sleeve 107. One tab 145 is located on keyway 108 and the other tab 145 is located on an opposing mounting mock keyway 108A.

Thus, in the assembled barrier light assembly 20, pivoting of the lens subassembly 22 causes the sleeve 107 to rotate which causes the bushing 99 to rotate and thereby turn holder 82. Consequently, each light source 24 and 25 is maintained at a focal point 42 that is aligned with its respective emission center line (see line 124 in FIG. 5) that is centered on the lens center line 81, as desired, as the lens subassembly 22 is pivoted.

Optionally, as those skilled in the art will appreciate, other configurations for bushing 99 and sleeve 107 can be utilized, if desired. Also, the bushing and the sleeve can be unitarily formed as a single body, if desired.

Figure 5:
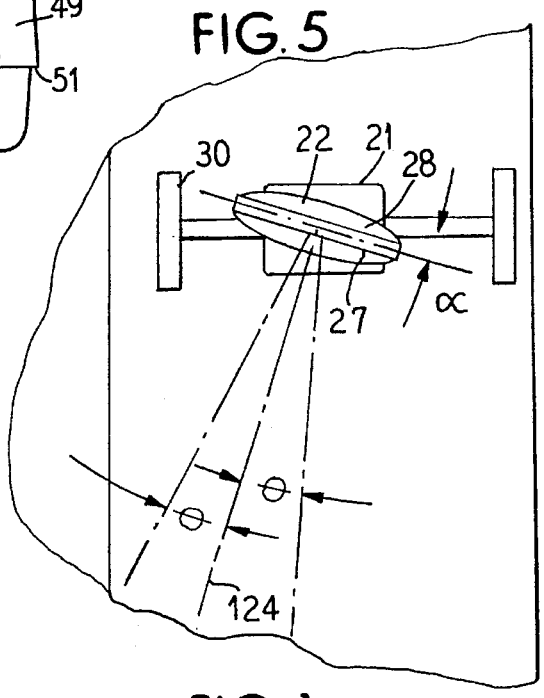
FIG. 5 is an environmental top plan view showing the embodiment of FIG. 4 located upon a construction barrier with its lens subassembly pivoted relative to its base case subassembly.
Figure 7:
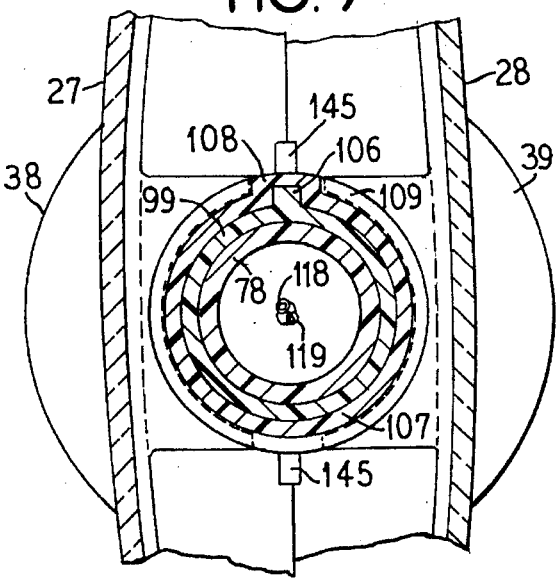
FIG. 7 is a transverse sectional view taken along the line VII—VII of FIG. 6.
Figure 1:
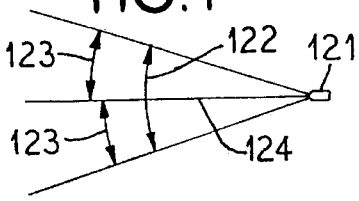
FIG. 1 is a diagrammatic side elevational view illustrating the limited light field emitted by a limited field light source such as an LED.
Figure 8:
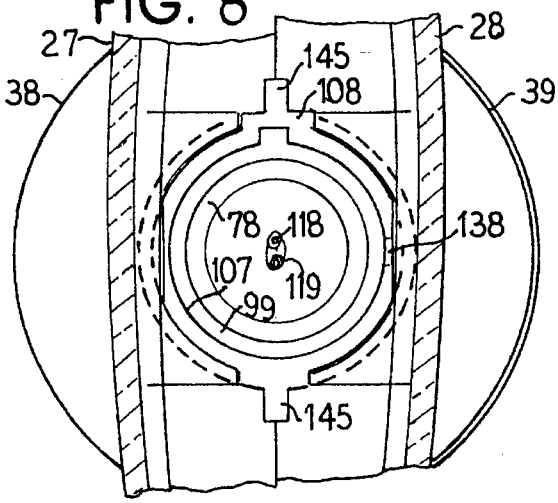
FIG. 8 is a transverse sectional view taken along the line VIII—VIII of FIG. 6.
Figure 9:
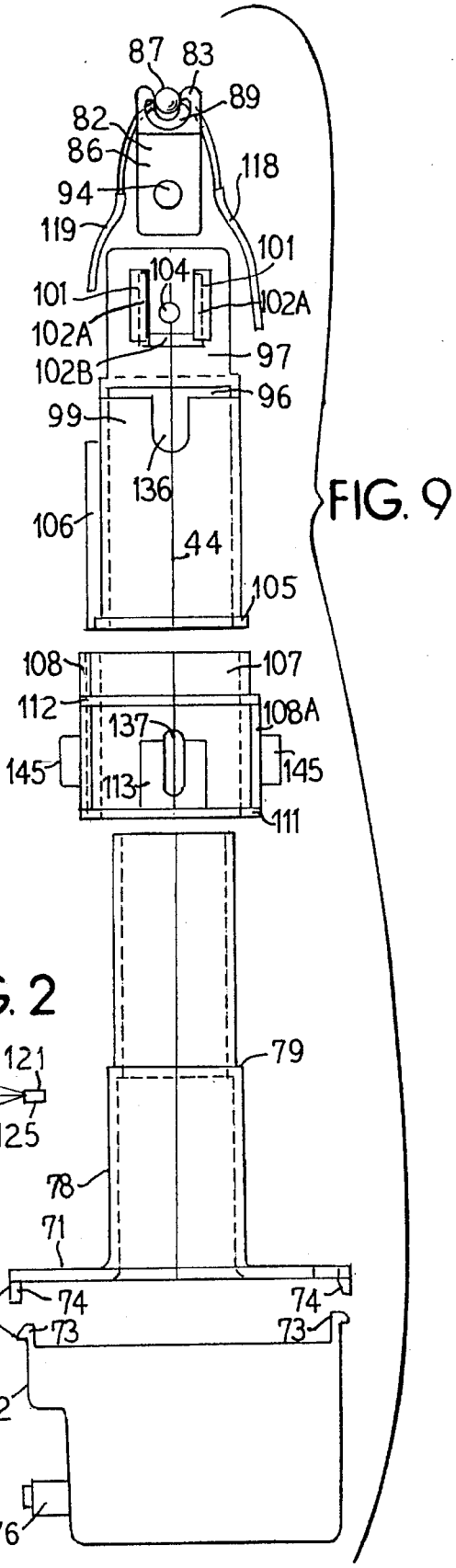
FIG. 9 is an exploded side elevational view of a subcombination that is incorporated into the embodiment of FIG. 4 showing the limited field light source, here a pair of light emitting diodes (or LEDs), and their associated self-orienting, lens coupled, light source holding and positioning subassembly.
Figure 10:
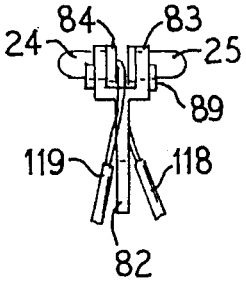
FIG. 10 is a side elevational view of the LEDs and their holder as shown in FIG. 9, but turned at 90° relative to their position as shown in FIG. 9.
Figure 11:
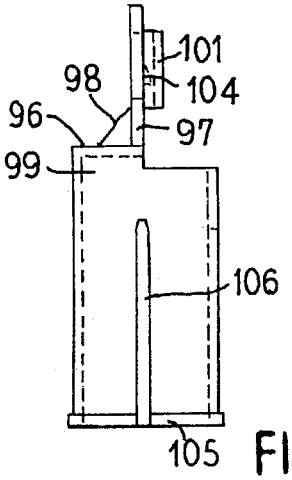
FIG. 11 is a side elevational view of the bushing and the integrally formed holder bracket as shown in FIG. 9, but turned at 90° relative to their position as shown in FIG. 9.
Figure 12:
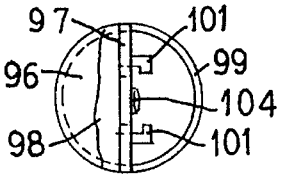
FIG. 12 is a transverse sectional view taken along the line XII—XII of FIG. 11.
Figure 2:
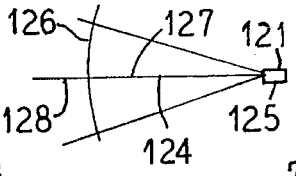
FIG. 2 is a side elevational view similar to FIG. 1, but with the addition of a lens member of a barrier light, this view illustrating the light focusing effect achieved by such lens member upon the light emitted by the light source of FIG. 1 when this light source is located at the lens focal point and also when the light emission center line of the light source is coincident with the lens center line.
Figure 13:
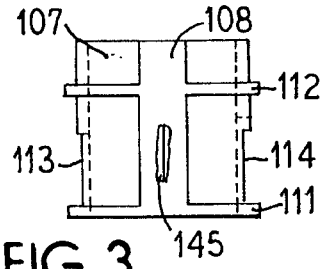
FIG. 13 is a side elevational view of the sleeve as shown in FIG. 9, but turned at 90° relative to the position shown in FIG. 9.
Figure 3:
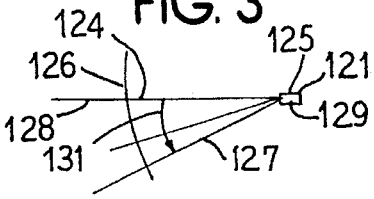
FIG. 3 is a side elevational view similar to FIG. 2, but showing the effect of light reaching and passing through such lens member after such lens member has been pivoted about an axis that passes vertically through the lens focal point with the position of the light source being fixed, the lens pivoting being such that the deviation angle is illustratively between 0° and the maximum value where no emitted light from this light source reaches this lens member.
Figure 14:
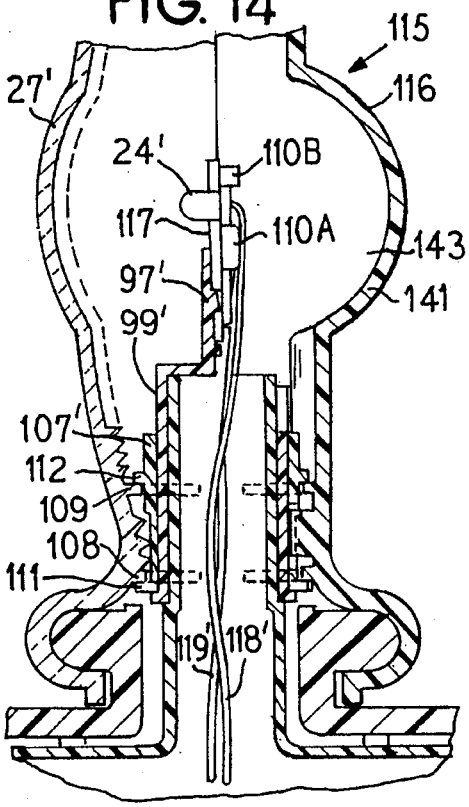
FIG. 14 is a view similar to FIG. 6, but showing an alternative embodiment of a barrier light structure of this invention which employs as a limited field light source a single LED.
Figure 15:
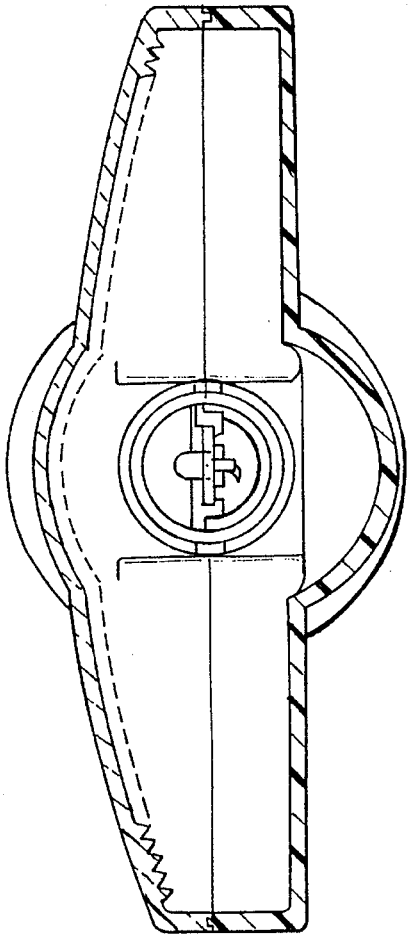
FIG. 15 is a top plan view of the embodiment shown in FIG. 14.
Figure 16:
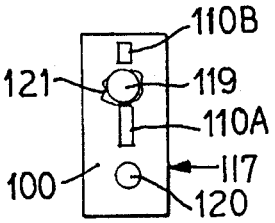
FIG. 16 is a side elevational view of the single LED holder employed in the embodiment of FIG. 14, but turned at 90° relative to the position shown in FIG. 14.

The operation of barrier light assembly 20 on a barrier support 30 is diagrammatically illustrated in FIG. 5. Here, the lens subassembly 22 is pivoted at an angle α relative to case subassembly 21. Light rays are shown being emitted only through lens half 27, for present illustration purposes, along and about an emission center line 124 within a field half angle Θ (shown extended and projected through lens half 27 without showing any lens focusing). Because of the operation of subassembly 26, the emission center line 124 remains aligned with the lens center line of lens half 27 even though the lens assembly 22 has been so pivoted, and no appreciable misalignment or light loss occurs because the lens subassembly 22 is so pivoted.

The amount of light emitted from a lens, such as lens half 27, that is being illuminated by a conically shaped beam from a light-emitting limited field light source, such as LED 24, is related proportionally to the amount of light from such light emitting source which strikes the inside surface of the lens half 27. As above-indicated, emitted light from an LED extends only through some predetermined half-angle Θ. This half angle Θ of emitted light from a given light emitting source can range widely depending on the light emitting source being used; for example, the half angle Θ may range from about 15° to about 75° for a particular LED 24. To have the light emitted from an LED 24 impinge upon the inside surface of the lens half 27 so that some desired area of the impinged upon a lens half 27 is illuminated, the spacing between that lens half 27 and that LED 24 measured along the emission center line 124 can be adjusted, if desired. For example, in FIG. 25, a molded (preferably clear plastic) lens half 27' is provided with an integrally formed, laterally outwardly extending, circumferentially located (about the periphery of each lens half 27') extension shoulder 173 so as to provide a means for increasing the spacing between lens half 27' and LED 24' along the LED emission center line 124 (compare to the lens half 27 in FIG. 6 where no shoulder is present).

Because of the many field applications for a barrier light assembly which is visible in substantially one direction only, an alternative embodiment 115 of a barrier light assembly of this invention is provided, such as shown, for example, in FIGS. 14–17. In barrier light assembly 115, components similar to those in barrier light assembly 20 are employed and are similarly numbered, but with the addition of prime marks thereto for identification purposes.

In barrier light assembly 115, the lens half 28 is replaced by a shaped back lens housing 116. Housing 116 is conveniently formed of an injection molded plastic that preferably is similar to than employed for lens half 28, but housing 116 contains no formed lenticular or faceted portions. Housing 116 contains a longitudinally extending, rearwardly flanged periphery and sleeves 46' that are comparable to sleeves 46 in the lens half 28. Housing 116 and lens half 27' are interconnected together by screws (not shown) similar to screws 50.

In the barrier light assembly 115, only a single limited field light source 24' is employed. Light source 24' is supported by a holder 117 which is similar to holder 82 in function except that, in holder 117 (see, for example, FIG. 14), the legs 83 and 84 and the stem 86 are eliminated and replaced by a single elongated stem 100. The upper end of the holder 117 is provided with a hole 119 and a circumscribing outstanding supporting flange 121. This combination of hole 119 and flange 121 functions to receive and hold circumferentially the light source 24'.

The holder 117 is interchangeably usable with holder 82. Thus, holder 117 is slidably engagable with channels 101 and a hole 120 in the lower portion of holder 117 is releasably engagable with detent 104. Added structural rigidity for holder 117 is achieved by central longitudinally elongated ribs 110A and 110B.

Thus, the same component combination of bushing 99', bracket 97' and sleeve 107' is employable in barrier light assembly 115 to maintain position and orientation of the light source 24 relative to the focal point 42' and the lens center line 81' of lens half 27', as desired, that is employed in the barrier light structure 20.

A cleft 136 is optionally (and as shown; see FIG. 9) provided adjacent the upper end of bushing 99 to facilitate extending through bushing 99 during assembly the prewired combination of light sources 24 and 25.

To aid in assembly of components, and to avoid mismatching and/or misassembly of components when the sleeve 107 is being used as sleeve 107' in barrier light 115, the second flat area 114 is further optionally provided with a longitudinally elongated slot 137 (see FIG. 9) that is adapted to engage with an optional mating aligning rib 138 that is integrally formed in back lens housing 116. Such a rib 138 is not present in the lens halves 27, 27' and 28. Ears 145 on sleeve 107 (see FIG. 9) are optional and are usable for alignment purposes in assembly.

The back lens housing 116, as shown, is preferably provided with a central, axially projecting, generally hemispherically configured projection 141 which provides a preferred interior space for an interior cavity 143 in the lens subassembly 142 (involving the lens half 27 with back lens housing 116) in the barrier light assembly 115. If desired, the cavity 143 can hold an opaque, light collecting reflector element (not shown) which can be used when the limited field light source being used involves some stray light (which is not present with the most preferred LEDs used in the practice of this invention).

While various wiring component arrangements can be used for purposes of permitting the lens subassembly 22 or 142 to be pivoted without disrupting functional wire interconnection between source lights and electrical components in housing 23, as those skilled in the art will appreciate, it is now convenient and preferred to employ lead wires 118 and 119 which have length and flexibility at least sufficient for a lens subassembly to be rotated through a given number of complete revolutions before problems arise. Field experience suggests that usually a lens subassembly is not so rotated completely during the lifetime of a given barrier light assembly more than perhaps 5 or 6 times. Therefore, sufficient wire to permit at least about 15 complete rotations is presently preferred although wire for more complete turns, such as at least about 20, can be used, if desired.

Particularly to avoid any electrical short in the vicinity of the light sources, such as 24/25 or 24', it is desirable and now preferred to incorporate wire spacer means into a barrier light assembly of the invention. Conveniently and preferably, the spacer means is incorporated into a holder.

Figure 17:
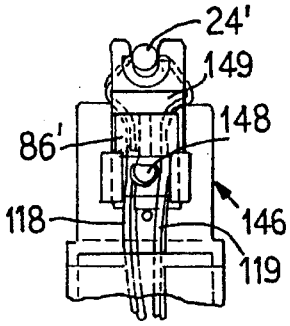
FIG. 17 is a fragmentary view of the upper end region of the holder and bracket combination shown in FIG. 9, but showing an alternative embodiment of the holder.
Figure 19:
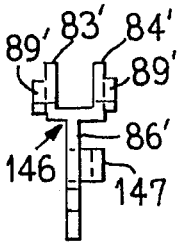
FIG. 19 is a side elevational view of the holder of FIG. 18, but turned at 90° relative to the position shown in FIG. 18.
Figure 18:
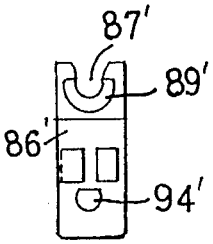
FIG. 18 is a side elevational view of the holder embodiment shown in FIG. 17, this holder being suitable for holding two source lights.
Figure 20:
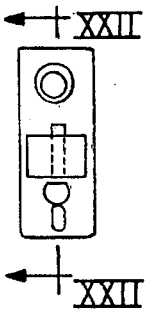
FIG. 20 is a side elevational holder view similar to FIG. 18, but showing an alternative holder embodiment, this holder being suitable for holding a single source light.
Figure 22:
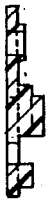
FIG. 22 is a longitudinal sectional view taken along the line XXII—XXII of FIG. 20.
Figure 21:
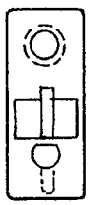
FIG. 21 is a side elevational view of the opposite side of the holder shown in FIG. 20.
Figure 23:
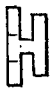
FIG. 23 is a top plan view of the holder of FIG. 20.

An embodiment of a two light source holder 146 is shown in FIGS. 17–19 that is suitable for use in assembly 20. Holder 146 is, like holder 82, similarly adapted for slip fit engagement with a bracket 97' of a bushing 99', as shown in FIG. 17. Components in holder 146 that are similar to components in holder 82 are similarly numbered, but with the addition of prime marks for identification purposes.

Holder 146 is provided with an integral wire spacer and guide structure 147 which comprises a central elongated flattened post 148 in a mid-region of stem 86' and a flat cross member 149 located transversely across post 148. Thus, as illustratively shown in FIG. 17, the lead wires 118 and 119 are extended downwardly from the sources 24 and 25 along holder 146 so that each wire 118 and 119 rests in a different side of the post 148. An aperture 151 and 152 is provided in stem 86' on each side of post 148 behind the overlying portion of cross member 149. Each wire 118 and 119 can be extended through a different aperture 151 and 152 and thereafter extends along the edges of the channels 101'. Thus, when the bracket 97 is rotated, with the stem 86' engaged therewith, the wires 118 and 119 are separately maintained, thereby preventing contact between the bare wires that are connected to the respective lead wires 118 and 119.

The single light source holder 155 shown in FIGS. 20–23 is similar to holder 117, but is provided with a wire separator 156 which utilizes a cross plate 157 on the reinforcing rib 110A'. Parts of holder 155 that are comparable to holder 117 are similarly numbered, but with the addition of prime marks thereto for identification purposes. Holder 155 is equipped with an aperture 159 and 161 on each side of rib 110A behind cross plate 157 which function analogously to apertures 151 and 152.

Figure 24:
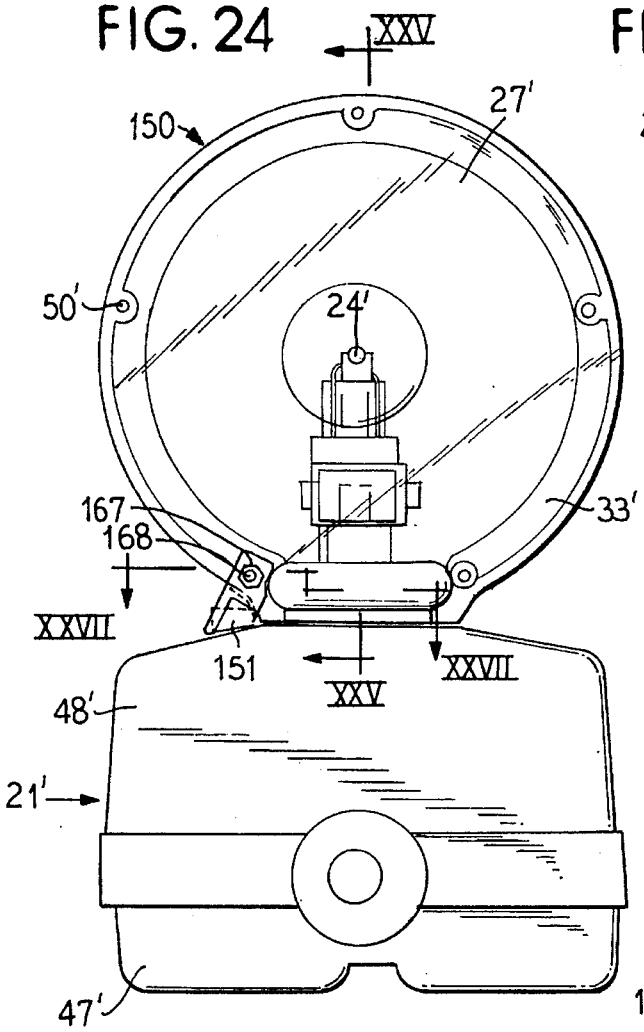
FIG. 24 is an elevational view of one side of alternative embodiment of a barrier light assembly of this invention.
Figure 25:
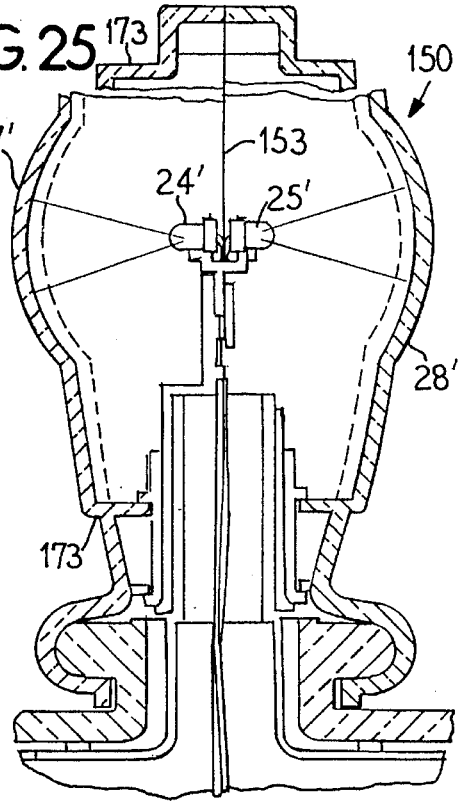
FIG. 25 is a fragmentary vertical transverse sectional view taken along the line XXV—XXV of FIG. 24.

Referring to FIGS. 24 through 28, there is seen a further alternative embodiment 150 of a barrier light assembly of this invention. The barrier light assembly 150 is similar in structure and function to the barrier light assembly 20; for convenience, corresponding parts of assembly 150 are similarly numbered, but with the addition of prime marks thereto for identification purposes. In FIGS. 24 and 25, the line halves 27' and 28' are illustratively considered to be transparent and the optical features are not detailed.

In barrier light embodiment 150, a fixed stop 151 (see FIGS. 24, 26 and 27) is associated with the top face of the upper portion 48' of the case assembly 21'. While fixed stop 151 is preferably integrally formed (i e., molded) with the top face of the upper portion 48', alternative association means can be employed, if desired, for associating a separately formed fixed stop 151 with upper portion 48' such as gluing, screwing or the like. To avoid thermal distortion problems during cooling of a molded hot thermoplastic upper portion 48', the fixed stop 151 is conveniently and preferably provided with a vertically ribbed internal structure, such as shown exemplarily in FIG. 27; however, the fixed stop 151 can have various configurations. Although various locations for fixed stop 151 on top portion 48' are possible, a preferred location is shown in the embodiment 150. Here, the fixed stop 151 is positioned in an offset location on the upper portion 48' top face adjacent to a (hypothetical) vertical plane (not shown) extending through the vertical axis 153 of the embodiment 150 and passing longitudinally and symmetrically through the mid-region of the case assembly 21.

Also, in embodiment 150, a rotational stop member 152 is provided (see especially FIG. 28) which is preferably unitarily but separately formed of a molded plastic, such as polypropylene, polycarbonate (now preferred) or the like. Rotational stop member 152 can have various constructional forms or configurations.

Thus, rotational stop member 152 has a base 163 that has a generally rectangular perimeter. A pair of flanges 164 and 165 normally extend outwardly and perpendicularly in symmetrical relationship to each other, each one from a different opposite end of base 163. A counter sunk aperture 166 and 167 is defined in each flange 164 and 165, respectively, so that the apertures 166 and 167 are longitudinally aligned with each other. Aperture 167 is preferably provided (as shown) with a hexagonally configured sidewall for receiving a nut 167 while aperture 166 is preferably provided (as shown) with a round sidewall for receiving the notched screw-type head of a bolt 168 that is matable with the nut 167.

Projecting perpendicularly and outwardly from the opposite side of base 163 (relative to flanges 164 and 165) and extending along not more than about one half the length of a side edge of the base 163 is a wall 171. For bracing purposes, wall 171 is preferably provided with a triangularly configured rib 172 that extends between the inner edge of wall 171 and the adjacent face of the base 163. Preferably, the base 163 is longitudinally divided into two approximately equally sized interconnected portions that are slightly canted relative to each other.

When, in lens subassembly 22', a lowermost retaining screw 50' is removed and the screw hole is bored, the base 163 can span across the adjacent outside edge portions of the interengaged lens halves 27' and 28' with the flanges 164 and 165 being received over a portion of the band 33' of the halves 27' and 28'. The bolt 168 is extendable successively through aperture 166, halves 27' and 28' and aperture 167 for threadable engagement with nut 167. Thereby, the rotational stop member 152 is engaged with the lens subassembly 22'.

In place of the rotational stop member 152, one can employ the rotational stop member 174 which, like rotational stop member 152, is preferably formed of a molded plastic, such as polypropylene, polycarbonate (now preferred) or the like. The rotational stop member 174 is now preferred for use with a barrier light of this invention, such as embodiment 150.

Rotational stop member 174 has a base 176 (comparable to about one-half the size of base 163) and has a flange 177 that normally extends outwardly and perpendicularly from base 176. A counter sunk aperture 178 is defined in flange 177 and includes an inwardly extending cylindrical support shoulder 179.

Projecting perpendicularly and outwardly from the opposite side of base 176 (relative to flange 177) and extending along the side edge of the base 176 is a wall 181. For bracing purposes, wall 181 is preferably provided with a triangularly configured rib 182 that extends between base 176 and the inner edge of wall 181. Preferably, the base 176 is, like base 163, longitudinally divided into two approximately equally sized interconnected portions that are slightly canted relative to each other.

When, in lens subassembly 22', a lowermost retaining screw 50' is removed from its threaded screw hole, the base 176 can be positioned across the adjacent outside edge portion of the interengaged lens halves 27' and 28' with the flange 177 being positioned adjacent a portion of the band 33'. Screw 50' (or another slightly longer screw, not shown, if desired) is then extendable through aperture 178 and shoulder 179 for threadable engagement with the threaded screw hole. Thereby, the rotational stop member 174 is engaged with one side portion and an edge portion of the lens subassembly 22'.

Figure 27:
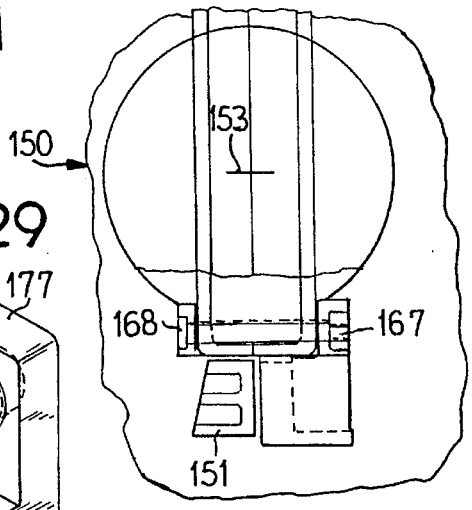
FIG. 27 is horizontal transverse sectional view taken along the line XXVII—XXVII of FIG. 24.
Figure 26:
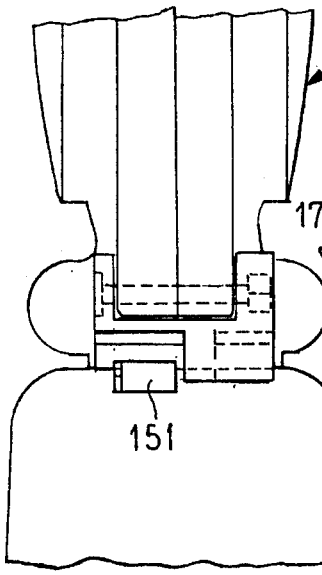
FIG. 26 is a fragmentary end elevational view of the mid-region taken from the left side of the barrier light embodiment shown in FIG. 24.
Figure 29:
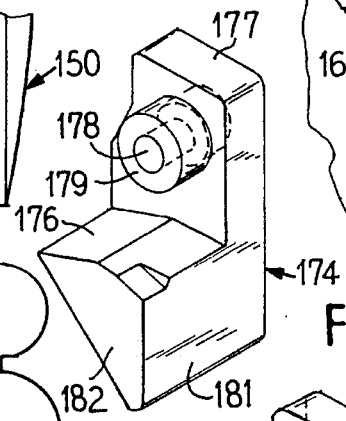
FIG. 29 is a perspective view of an alternative embodiment of a rotational stop member that is suitable for employment in the alternative barrier light embodiment of FIGS. 24–27.
Figure 28:
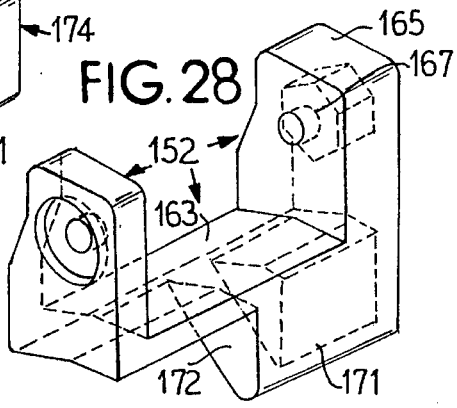
FIG. 28 is a perspective view of the rotational stop member employed in the alternative barrier light embodiment of FIG. 24.

This, when equipped with either one of the rotational stop members 152 or 174, the lens subassembly 22' is rotatable about vertical axis 153 from the position shown, for example, in FIGS. 24, 26 and 27 through an angle in excess of about 350° until the wall 171 of rotational stop member 152 is brought into engagement with one side of fixed stop 151 so that further rotation of lens subassembly 22' is not possible. However, the lens subassembly 22' remains positionable relative to case assembly 21' at any desired intervening angle. The fixed stop 151 and either the rotational stop member 152 or the rotational stop member 174 thus cooperate to limit pivotability of lens subassembly 22' relative to case assembly 21' which is desirable to avoid excessive spiral twisting of the lead wires 118' and 119' for the LEDs 24' and 25', as those skilled in the art will appreciate. Of course, various alternative stop arrangements can be employed, if desired.

It should be understood that various modifications, changes and variations may be made in the invention without departing from the spirit and scope thereof. The present disclosure is intended to exemplify the invention and not to limit the invention.

What is claimed is:

1. In a barrier light assembly of the type comprising in combination:

a case subassembly;

a lens subassembly adjacent to and supported by said case subassembly and pivotable relative thereto about a generally vertical axis, said lens assembly including a lens with peripherally associated wall portions which together with said lens extend about and define an interior chamber, said lens having a lens center line and also a lens focal point that is located in said chamber along said lens center line, said focal point being substantially coincident with said vertical axis;

a housing subassembly for electrical components configured for nestable receipt in said case subassembly and having an elongated projecting pedestal which extends into said lens subassembly along said vertical axis; and a light source in said interior chamber case assembly; an improvement which comprises:

said light source having a limited light emitting field that is distributed about an emission center line;

holder means for said light source; and a self-orienting, lens subassembly coupled holding and positioning subassembly for said light source, said holding and positioning means comprising in combination:

(1) bushing means slidably engaging said pedestal and rotatable relative thereto;

(2) sleeve means slidably engaging said bushing means and including means for keying said sleeve means to said bushing means so that said sleeve means and said bushing means rotate together, and further including sleeve portions for engaging interior portions of said lens subassembly so that said sleeve means and said lens subassembly rotate together; and (3) bracket means interconnecting said bushing means with said holder means so that said light source is maintainable with said emission center line located approximately along said lens center line and with said light source located about at said focal point; an interrelationship between said light source, said holder means, said holding and positioning subassembly, said lens subassembly, said housing subassembly and said case subassembly being such that, when said lens subassembly is so pivoted, said light source remains at said lens focal point and said lens center line remains approximately coincident with said emission center line.

2. The improved barrier light assembly of claim 1 wherein said bushing means and said sleeve means are unitarily connected.

3. The improved barrier light assembly of claim 1 wherein said bracket means is unitarily formed with said bushing means.

4. The improved barrier light assembly of claim 1 wherein said light source is directly and adjacently connected to electrically conductive wire means and wherein separating means for said wire means is included.

5. The improved barrier light assembly of claim 1 wherein said lens subassembly comprises a pair of substantially identically configured lens halves which are in mating and abutting engagement with one another along opposed peripheral edge portions to define said interior chamber therebetween with said lens halves being oriented so as to have a common said lens center line, and each of said lens halves has a lens focal point that is located in said chamber along said lens center line and each of said focal points is approximately at or adjacent to said vertical axis, and said lens assembly includes fastening means for fastening said lens halves in said engagement and wherein a pair of said light sources are incorporated, each said light source being held by said holder means, said interrelationship being such that, when said lens subassembly is so pivoted, each of said light sources remains approximately at the focal point of a different one of said lens halves and also said lens center line remains approximately coincident with said emission center line of each of said light sources.

6. A barrier light assembly comprising in combination:

(a) a case subassembly comprising:

two portions which are in cooperative engagement along a perimeter region to define an interior cavity therewithin for receiving battery means, securing means for fastening together said portions in said engagement, said case assembly having an upstanding cylindrical case neck that terminates in an upwardly opening case mouth with a radially outwardly thickened circumferentially extending lip;

(B) a lens subassembly comprising:

a pair of dish configured members which matingly and abuttingly engage with one another along opposed peripheral edge portions to define an interior chamber therebetween with said members being oriented so as to have a common lens center line, fastening means for fastening together said members when so engaged, each one of said members being comprised of a substantially transparent material and having a central region with a lenticular configuration that has a focal point in a center portion of said chamber along said common lens center line, each said member further having an integral collar half located along an edge portion thereof, said respective collar halves being cooperative with one another to define a collar so that, when said members are so engaged, said lip is circumscribed slidably by said collar and a circular orifice is defined in said collar about a diameter extending from said focal point in said chamber whereby said lens subassembly is pivotable relative to said case subassembly about an axis corresponding to said diameter;

(C) a housing subassembly for electrical components, said housing subassembly having a body portion configured for nestable receipt in said cavity adjacent said neck and further having an elongated, projecting hollow pedestal which upwardly extends through said mouth and into said chamber so that the axis of said pedestal extends along said diameter;

(D) a limited field light source having an emission center line and an associated holder means for said light source;

(E) a self-orienting, lens coupled holding and positioning subassembly for said light source and said holder means comprising in combination:

(1) bushing means slidably engaging said pedestal and rotatable relative thereto;

(2) sleeve means slidably engaging said bushing means and including means for keying said sleeve means to said bushing means so that said sleeve means and said bushing means rotate together, and further including sleeve portions for engaging interior portions of said lens subassembly so that said sleeve means and said lens subassembly rotate together; and (3) bracket means axially upstanding from said bushing means and including means for associating said holder means therewith along said diameter so that said light source is maintainable with said emission center line located approximately along said lens center line and with said light source located about at said focal point; an interrelationship between said light source, said holder means, said holding and positioning subassembly, said lens subassembly, said housing subassembly and said case subassembly being such that, when said lens subassembly is so pivoted, said light source remains at said focal point and said lens center line remains approximately coincident with said emission center line.

7. The barrier light assembly of claim 6 wherein said bushing means and said sleeve means are unitarily connected.

8. The barrier light assembly of claim 6 wherein said bracket means is unitarily formed with said bushing means.

9. The barrier light assembly of claim 6 wherein said light source is directly and adjacently connected to non-insulated wire means, and wherein separating means for maintaining said non-insulated wires in a separated relationship adjacent said light source is included.

10. The barrier light assembly of claim 6 wherein said holder means includes wire separating means.

11. The barrier light assembly of claim 6 wherein said housing subassembly contains said electrical components, wherein wire means connects said light source to said electrical components and said wire means extends through said pedestal means between said light source and said electrical components in said housing subassembly, and wherein wire separating means for said is provided adjacent to said light source.

12. The barrier light assembly of claim 9 wherein the length and flexibility of said wire means is at least sufficient for said lens subassembly to be rotated through at least about 15 complete revolutions in one direction.

13. The barrier light assembly of claim 6 wherein said pair of dish configured members of said lens subassembly comprises a pair or substantially identically configured lens halves which are matingly and abuttingly engaged with one another along opposed peripheral edge portions to define said interior chamber therebetween, and including fastening means for fastening said lens halves in said engagement and wherein a pair of said light sources are incorporated, each said light source being held by said holder means, the said interrelationship being such that when said lens subassembly is so pivoted.

14. The barrier light assembly of claim 6 wherein said means for keying comprises a longitudinally extending, radially outstanding integral key on said bushing means and a longitudinally extending keyway recess defined in a sidewall portion of said sleeve means said keyway recess being longitudinally slidable in said sleeve means.

15. The barrier light assembly of claim 6 wherein said sleeve portions comprise localized flattened regions defined in circumferential outer areas thereof.

16. The barrier light assembly of claim 9 wherein said separating means is integrally associated with said holder means.

17. The barrier light assembly of claim 6 wherein said holder comprises an elongated flattened stem which has a hole means adjacent one end thereof for receiving therethrough a body portion of said light source, and which includes a defined surface configuration adjacent the opposite and thereof for association with said bracket means in a predetermined spatial orientation.

18. The barrier light assembly of claim 13 wherein said holder has flattened, opposed sides and a Y-type configuration wherein each leg portion is adapted to hold a different one of said light sources in a terminally defined notch means thereof and wherein the stem portion has a defined surface configuration adjacent the open end thereof for association with said bracket means in a predetermined spatial orientation.

19. The barrier light assembly of claim 6 wherein said associated holder means comprises a pair of axially extending axially equally spaced channels for slidably receiving and holding therebetween opposite side portions of said holder means.

20. The barrier light assembly of claim 19 wherein said associated holder means further includes detent means, and detent biasing means, whereby said detent is releasably engagable with a predetermined position in said holder means.

21. The barrier light assembly of claim 6 which includes stop means for limiting the pivotability of said lens subassembly relative to said case subassembly.

22. The barrier light assembly of claim 21 wherein said stop means comprises a fixed stop member associated with said case subassembly and a rotational stop member associated with said lens subassembly, the location of said fixed stop member relative to said rotational stop member being such that said lens subassembly is continuously pivotable relative to said case assembly through an angle of at least about 350°.

23. The barrier light assembly of claim 6 wherein at least one of said pair of disk configured members further includes an integrally formed, laterally outwardly extending circumferentially located extension shoulder whereby the spacing between said one disk configured member and the adjacent said limited field light source along the emission center line is extendable.

* * * * *